United States Patent [19]

Query

[11] Patent Number: 4,860,551

[45] Date of Patent: Aug. 29, 1989

[54] FROST SENSOR FOR AN APPLIANCE

[75] Inventor: Daniel S. Query, Antioch, Tenn.

[73] Assignee: Whirlpool Corporation, Benton Harbor, Mich.

[21] Appl. No.: 139,266

[22] Filed: Dec. 29, 1987

[51] Int. Cl.[4] ..... F25D 21/02

[52] U.S. Cl. ..... 62/140; 62/151; 340/583

[58] Field of Search ..... 62/140, 151, 152, 155, 62/156, 139; 340/580, 583; 356/133; 73/73; 250/227

[56] References Cited

U.S. PATENT DOCUMENTS

| | | | |
|---|---|---|---|
| 2,355,014 | 8/1944 | Schorn | 62/140 |
| 3,280,577 | 10/1966 | Kobayashi et al. | 62/151 X |
| 3,540,025 | 11/1970 | Levin et al. | 340/583 X |
| 3,822,560 | 7/1974 | Hansen et al. | 62/151 X |
| 4,221,962 | 9/1980 | Black et al. | 250/227 |
| 4,240,747 | 12/1980 | Harmer | 356/133 |
| 4,593,533 | 6/1986 | Alsenz | 62/140 |

*Primary Examiner*—Harry B. Tanner

*Attorney, Agent, or Firm*—Mason, Kolehmainen, Rathburn & Wyss

[57] ABSTRACT

A fiber optic frost sensor for use in a refrigerating apparatus having evaporator coils is used to determine when ice or frost has accumulated on the evaporator coils to an extent that the air around the evaporator coils cannot be cooled efficiently. The frost sensor includes a fiber optic cable located adjacent to the evaporator coils, the fiber optic cable extending between a light transmitter and a light receiver. As ice and frost accumulate on the evaporator coils, the ice and frost also accumulate on the outer surface of the fiber optic cable resulting in a change in the amount of light traveling from the transmitter to the receiver through the fiber optic cable. When the amount of light received by the receiver changes a preselected amount, the receiver determines that a defrost cycle needs to be initiated to melt the accumulated ice or frost. In one embodiment, a serpentine fiber optic cable is looped along the evaporator coils. In another embodiment, notches or the like are provided in the external surface of the fiber optic cable. In yet another embodiment, a segmented fiber optic cable is used. In order to properly position the fiber optic cable adjacent to the evaporator coils, the fiber optic cable can be preassembled into a mounting bracket that snaps onto the evaporator coils.

10 Claims, 1 Drawing Sheet

FROST SENSOR FOR AN APPLIANCE

BACKGROUND OF THE INVENTION

1. Field of the Invention

The present invention relates to a frost sensor for a domestic appliance having refrigerating equipment and, more particularly, to a new and improved frost sensor for such an appliance, the frost sensor having a fiber optic cable positioned about evaporator coils of the refrigerating equipment to determine the extent to which ice or frost has accumulated on the evaporator coils.

2. Description of the Prior Art

Appliances such as a refrigerator/freezer, a freezer or a heat pump typically include evaporator coils as part of their refrigerating equipment. In the case of a refrigerator/freezer, the evaporator coils may be disposed in a rear cavity behind a panel in one of the refrigerated compartments. A refrigerating medium circulating through the evaporator coil is typically cooled by a compressor to cool the air in the rear cavity of the refrigerator/freezer. The cooled air is then circulated through the refrigerated compartments to maintain those compartments at the proper refrigerated temperatures. Ice and frost tend to accumulate on the evaporator coils as the air is being cooled. A layer of ice and frost on the evaporator coils insulates the evaporator coils from the air to be cooled, making it difficult for the refrigerating equipment to maintain the refrigerated compartments at the desired cool temperatures.

In order to melt the ice or frost that has accumulated on the evaporator coils, a defrost cycle is typically initiated during which the compressor is turned off. In known refrigerator/freezers, the defrost cycle is controlled by a clock mechanism that turns off the compressor during preselected time intervals. During the defrost cycle, the clock mechanism also actuates a heating device located near the evaporator coils to assist in melting the accumulated ice and frost. However, depending on such factors as the ambient humidity and temperature, ice and frost accumulates on the evaporator coils at varying rates. Consequently, the clock mechanism may actuate the defrost cycle more often than is necessary to maintain the evaporator coils free of ice and frost.

In those systems that turn off the compressor at regular intervals, the compressor tends to be turned off for an unnecessary length of time in order to ensure that a sufficient amount of time is allowed to melt the ice or frost. When the compressor is turned off for an unnecessarily long period of time, the temperature in the refrigerated spaces rises resulting in the refrigerating equipment being run for an increased amount of time to return the refrigerated spaces to the desired cool temperatures after the defrost cycle has been completed.

In other known defrost systems, temperature sensors measure the temperature of the refrigerating medium and a defrost cycle is initiated in response to a predetermined change in that temperature. In order for these temperature sensors to be useful, they must be extremely sensitive to small changes in the temperature of the refrigerating medium because very small variations in this temperature occur over large variations in the accumulation of ice or frost on the evaporator coils. Consequently, these temperature sensors typically do not accurately reflect the amount of ice and frost that has accumulated on the evaporator coils.

In some defrost systems, optical devices have been used to determine the accumulation of ice and frost in a refrigerator. For example, in U.S. Pat. No. 2,225,932, a pair of Lucite rods positioned end to end are spaced apart in a refrigerator so that a gap is formed between the rods. Whenever the door of the refrigerator is opened, a bulb located at one end of one of the rods is energized. If the end of the other rod glows, it provides a visual indication to the user that frost has not built up in the gap between the rods to the extent that light from the bulb is blocked so that the refrigerator does not need defrosting. However, if too much frost has accumulated in the gap between the rods, the end of the other rod does not glow indicating that the refrigerator does need to be defrosted.

U.S. Pat. No. 4,578,959 discloses another optical system used in determining to what extent frost has accumulated on the evaporator coils of refrigeration equipment. In the system disclosed in that patent, electromagnetic radiation having a narrow band of wavelengths is projected onto the frost accumulating on the evaporator coils. The electromagnetic radiation passes through the frost to the evaporator coils where it is reflected back through the frost to a detector that is sensitive to the selected wavelength of the electromagnetic radiation. The amount of radiation that is detected is an indication of the amount of frost that has accumulated on the evaporator coils because the radiation is absorbed or scattered by the frost in a relation proportional to the thickness of the frost that has formed on the evaporator coils.

Neither of these patents (U.S. Pat. Nos. 2,225,932 and 4,578,959) discloses the use of fiber optics to detect the accumulation of ice and frost on evaporator coils of refrigeration equipment. On the other hand, fiber optics have been used to detect the present or absence of a liquid such as oil leaking from a storage tank. One such use is described in U.S. Pat. No. 4,270,049 wherein oil leaks drop onto a light guide or optical fiber. The amount of light traveling from one end of the optical fiber to the other end is affected by the amount of oil that has accumulated on the optical fiber to provide an indication of the amount of oil that has leaked.

Light transmitting tubes or the like have been used to detect the level to which a liquid has risen in a container or vessel. For example, such level detection devices are disclosed in U.S. Pat. Nos. 3,192,392; 3,683,196; 3,995,169; and 4,187,025. In U.S. Pat. Nos. 3,192,392 and 3,683,196, light transmitting tubes with at least one notch formed in their outer surfaces extend into a container of liquid. When light travels along the tube, it is reflected by the inclined surfaces of the notches. The amount of light transmitted through the tube varies depending on whether the liquid in the container has reached the level of the notches in the tube since light is reflected differently when the notches are filled with a liquid. In U.S. Pat. No. 3,995,169, light tubes are disposed within a tank of liquid. Each of the tubes has a U-shaped bend with flat surfaces along the outer sides of the bend. The amount of light that is transmitted through the light tube is altered by the extent to which the liquid makes contact with the flat outer surfaces of the bend. Another liquid level detector is disclosed in U.S. Pat. No. 4,187,025 wherein an elongated light conducting body or tube is formed with several curved sections. When the liquid rises to cover the curved sections of the tube, the amount of light that is transmitted from one end of the tube to the other end of the tube is altered.

Liquid level detectors are not the only devices in which light transmitting tubes having notches in their outer surfaces have been used. For example, in U.S. Pat. No. 2,909,857, a light pipe is disclosed which has a series of notches so that the light traveling through the light pipe illuminates counters positioned adjacent to each of the notches. In U.S. Pat. No. 3,526,880, notches in light conducting rods or fibers are positioned adjacent to sensors used in a binary digital memory. On the other hand, a light conducting rod formed of an array of stepped individual mirrors is disclosed in U.S. Pat. No. 4,196,962 for use in transmitting a laser beam.

SUMMARY OF THE INVENTION

One object of the present invention is to provide a new and improved ice and frost sensor for an appliance such as a refrigerator/freezer which sensor utilizes a fiber optic cable.

Another object of the present invention is to provide a new and improved fiber optic ice and frost sensor for a refrigerator/freezer in which light is transmitted from a transmitter to a receiver via a fiber optic cable and the amount of light traveling through the fiber optic cable is indicative of the amount of ice or frost that has accumulated on the fiber optic cable.

Yet another object of the present invention is to provided a new and improved fiber optic frost detector for a refrigerator/freezer in which a serpentine fiber optic cable is positioned adjacent to evaporator coils in the refrigerating portion of a refrigerator/freezer to determine the amount of ice or frost accumulating on the evaporator coils based on the amount of light transmitted through the fiber optic cable.

Still another object of the present invention is to provide a new and improved frost sensor for a refrigerator/freezer having a notched fiber optic cable positioned adjacent to the evaporator coils of the refrigerating equipment so that as ice and frost accumulates in the notches of the fiber optic cable the amount of light transmitted through the fiber optic cable varies to provide an indication of the extent to which ice and frost has accumulated on the evaporator coils.

Another object of the present invention is to provide a new and improved frost sensor for a refrigerator/-freezer having a segmented fiber optic cable positioned adjacent to the evaporator coils of the refrigerating equipment so that as ice and frost accumulate in the gaps between the segmented portions of the fiber optic cable the amount of light traveling through the segments of the fiber optic cable varies to provide an indication of the extent to which ice and frost has accumulated on the evaporator coils.

Yet another object of the present invention is to provide a new and improved mounting bracket for positioning a fiber optic cable adjacent to the evaporator coils of refrigerating equipment so that the fiber optic cable may be used to detect the amount of ice and frost accumulated on the evaporator coils.

In accordance with these and many other objects of the present invention, a fiber optic frost sensor is provided for use in a home or domestic appliance such as a refrigerator/freezer having a refrigerator compartment and a freezer compartment. In such refrigerator/freezers, the refrigerating equipment includes evaporator coils normally located in a rear cavity of the refrigerator/freezer behind a panel in the freezer compartment and connected via tubing or the like to a compressor located in an external area of the refrigerator/-freezer. The temperature of a refrigerating medium circulating through the evaporator coils is lowered by the compressor. As the cooled refrigerating medium circulates through the evaporator coils, the air in the cavity about the evaporator coils is also cooled and can be circulated through the freezer and refrigerator compartments to cool those compartments to desired low temperatures. The frost sensor is used to determine when ice and frost have accumulated on the evaporator coils to the extent that the air around the evaporator coils is not being cooled efficiently. The frost sensor includes a fiber optic cable located adjacent the evaporator coils. A light transmitter is located at one end of the fiber optic cable and a light receiver or detector is located at the other end of the fiber optic cable. As ice and frost accumulate on the evaporator coils, ice and frost also accumulate on the outer surface of the fiber optic cable resulting in an alteration of the amount of light traveling from the transmitter to the receiver through the fiber optic cable. When the amount of light being received by the receiver changes a preselected amount, the receiver can determine that a defrost cycle needs to be initiated to melt the accumulated ice or frost.

In one embodiment of the present invention, a serpentine fiber optic cable is looped along the evaporator coils so that ice and frost not only accumulates on the evaporator coils but also on the curved outer surfaces of the fiber optic cable. In another embodiment of the present invention, notches or the like are provided in the external surface of the fiber optic cable. Ice and frost tends to accumulate in the notches in proportion to the amount of ice and frost that is accumulating on the evaporator coils. The accumulation of ice and frost in these notches affects the amount of light transmitted through the fiber optic cable from the transmitter to the receiver. In yet another embodiment of the present invention, a segmented fiber optic cable is positioned adjacent to the evaporator coils. The ice and frost that accumulates in gaps formed between the segments of the fiber optic cable alters the amount of light traveling along the cable to the detector. In order to properly position the fiber optic cable adjacent to evaporator coils, the fiber optic cable can be preassembled into a mounting bracket that snaps onto the evaporator coils.

DESCRIPTION OF THE DRAWING

Many other objects of the present invention will become apparent from considering the following detailed description in conjunction with the drawing in which.

DESCRIPTION OF THE PREFERRED EMBODIMENT

Figure 1:
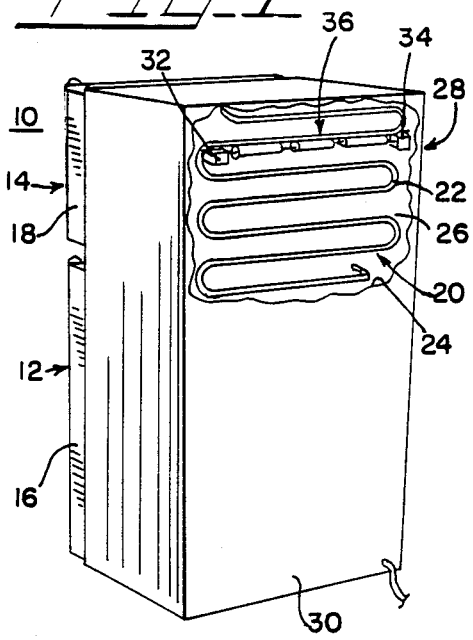
FIG. 1 is a perspective rear view of a refrigerator/-freezer with a portion of the back panel of the refrigerator/freezer broken away to illustrate the position of the frost sensor of the present invention with respect to evaporator coils in refrigerating equipment.

A top mount refrigerator/freezer 10, as shown in FIG. 1, has a lower refrigerator compartment or section 12 and an upper freezer compartment or section 14. The lower refrigerator section 12 is closed by a door 16 and the freezer section 14 is closed by a freezer door 18. The temperature within the refrigerator/freezer 10 is maintained by refrigerating equipment 20 that includes evaporator coils 22 disposed in a rear cavity 24 at the back of the refrigerator/freezer 10 and behind a rear panel 26 in the freezer compartment 14. A fiber optic frost sensor 28 embodying the present invention is provided in the rear cavity 24 adjacent to the evaporator coils 22. The frost sensor 28 is used to determine when ice or frost has accumulated on the evaporator coils 22 to the extent that air in the rear cavity 24 around the evaporator coils 22 is no longer being efficiently cooled.

The evaporator coils 22 are coupled via appropriate tubing or the like to a compressor located in an external area of the refrigerator/freezer 10, for example, near a lower portion 30 of the refrigerator/freezer 10. As is well known, the refrigerant circulated through the evaporator coils 22 absorbs heat (measured in BTUs) from the atmosphere surrounding the evaporator coils 22 to in turn cool the air in the rear cavity 24 so that the cooled air may be circulated through the freezer compartment 14 and the refrigerator compartment 16 in order to maintain the compartments 14 and 16 at desired cool temperatures. Ice or frost tends to accumulate on the evaporator coils 22 as the evaporator coils 22 are cooled by the refrigerating medium and this ice and frost tends to insulate the evaporator coils 22 from the air in the rear cavity 24 that is to be cooled. Consequently, the accumulation or build up of ice and frost on the evaporator coils 22 makes it difficult for the refrigerating equipment 20 to maintain the freezer compartment 14 and the refrigerator compartment 16 at the desired cool temperatures.

The frost sensor 28 is provided to determine when ice and frost have accumulated on the evaporator coils 22 to such an extent that the compressor should be turned off in order for the ice and frost to be melted. In the embodiment shown in FIGS. 1 and 2, the frost sensor 28 includes a transmitter 32, a detector or receiver 34 and a segmented fiber optic cable 36 extending between the transmitter 32 and the receiver 34. The transmitter 32 emits light that is projected across a gap 38 onto a fiber optic cable segment **36*a*. The light is transmitted through the cable segment 36*a*, across a gap 40 between the cable segment 36*a* and another cable segment 36*b*, through the cable segment 36*b*, across a gap 42 between the cable segment 36*b* and a cable segment 36*c*, across another gap 44 between the cable segment 36*c* and the receiver 34, and then to the receiver 34. When no ice or frost has accumulated on the evaporator coils 22, the gaps 38, 40, 42 and 44 also tend to be free of ice and frost. As a result, a given or normal amount of the light emitted by the transmitter 32 is transmitted through the fiber optic cable 36 and received by the receiver 34. As ice and frost accumulate on the evaporator coils 22, a proportional amount of ice and frost also tends to accumulate in the gaps 38, 40, 42 and 44. This accumulation of ice and frost alters the amount of light emitted by the transmitter 32 that travels through the cable 36 and is received by the receiver 34. Consequently, the change in the amount of light received by the receiver 34** can be detected.

As long as the amount of light being received by the receiver 34 does not change beyond a predetermined amount, standard available circuitry (not shown) coupled to or contained within the receiver 34 may make the determination that the accumulation of ice and frost on the evaporator coils 22 has not significantly affected the ability of the evaporator coils 22 to cool the air in the rear cavity 24. However, in the event that ice or frost does accumulate to a significant extent on the evaporator coils 22, the ice and frost that similarly has accumulated in the gaps 38, 40, 42 and 44 alters the amount of light being received by the receiver 34. When this change exceeds a predetermined amount, circuitry in the receiver 34 responds by initiating a defrost cycle. During a defrost cycle of the refrigerator/freezer 10, the compressor is maintained off so as to allow the ice and frost to melt. As the ice and frost melt from the evaporator coils 22, the ice and frost in the gaps 38, 40, 42 and 44 also melt so that the amount of light received at the receiver 34 from the transmitter 32 via the fiber optic cable 36 changes back to a predetermined amount. When the receiver 34 detects that a predetermined amount of light is being received, the defrost cycle is terminated. Consequently, the defrost cycle is maintained on only for the period of time necessary to melt the ice and frost that has accumulated on the evaporator coils 22.

While different lengths of fiber optic cable can be used for the segments **36*a*, 36*b* and 36*c*, 4" segments can be used when the cable 36 is about one to two meters long with about four to six segments, such as segments 36*a*, 36*b* and 36*c*, being used for every meter of cable length. When such a fiber optic cable is used, the gaps 38, 40, 42 and 44** can be about 0.02" to 0.025" in length.

Figure 3:
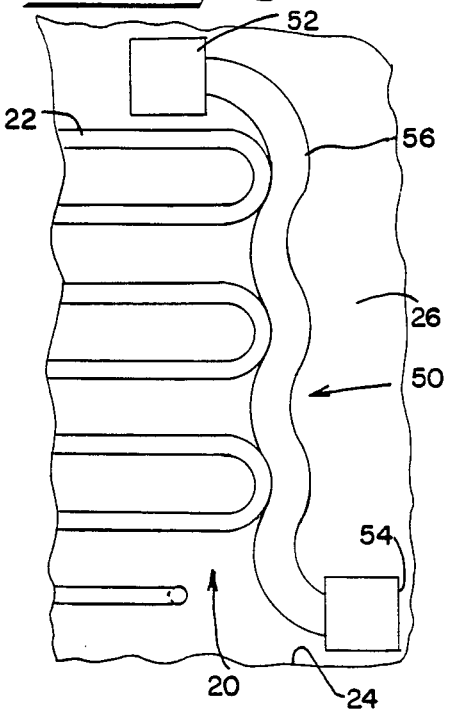
FIG. 3 is a partial, enlarged view of a portion of a refrigerator/freezer illustrating a second embodiment of the fiber optic frost sensor of the present invention.
Figure 2:
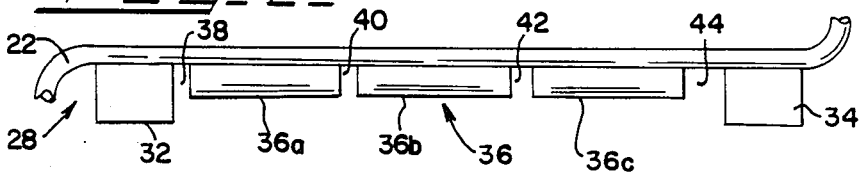
FIG. 2 is an enlarged view of a segmented fiber optic cable used in the frost sensor of FIG. 1.

In FIG. 3 of the drawing, another embodiment of frost sensor of the present invention is depicted. The portions of the refrigerator/freezer 10 and the refrigerating equipment 20 shown in FIG. 3 that are identical to corresponding portions shown in FIGS. 1–2 are designated by the same reference numerals. The frost sensor 50 includes a transmitter 52, a receiver 54 and a fiber optic cable 56 extending between the transmitter 52 and the receiver 54. The cable 56 is serpentined or looped around the evaporator coils 22. If no ice or frost has accumulated on the evaporator coils 22 or the fiber optic cable 56, light emitted from the transmitter 52 travels along the fiber optic cable 56 and is detected by the receiver 54. The amount of light that is received by the receiver 54 is not only dependent on the length and type of fiber optic cable 56 that is used, but also on the number of bends and the distance between the bends in the cable 56. For example, a cable 56 having a length of one to two meters could be configured such that the bends have a radius of curvature from 0.2" to 0.7".

When ice and frost accumulate on the evaporator coils 22, ice and frost will also accumulate at a proportionate rate on the outer surface of the fiber optic cable 56. The amount of light being received at the receiver 54 via the cable 56 will be altered in response to the build up of ice and frost on the cable 56. Once the amount of light being received at the receiver 54 is altered beyond a predetermined amount, circuitry coupled to or in the receiver 54 determines that an excess amount of ice and frost has accumulated on the evaporator coils 22 and a defrost cycle is initiated. As was the case with respect to the frost sensor 28, the frost sensor 50 is able to determine when an excess amount of ice and frost has accumulated on the evaporator coils 22 so that a defrost cycle is only initiated when necessary to melt the ice and frost. Moreover, since the frost sensor 50 can also determine when the ice and frost have been sufficiently melted during a defrost cycle, the duration of the defrost cycle can be kept to a minimum.

Figure 4:
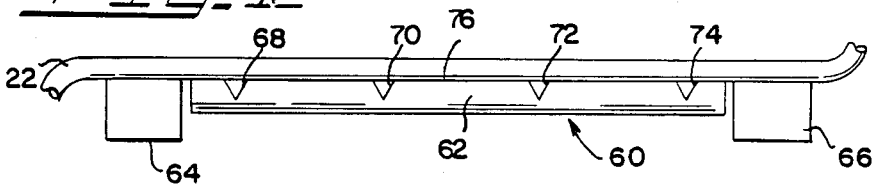
FIG. 4 is an enlarged view illustrating a third embodiment of the fiber optic frost sensor of the present invention.

Another embodiment of the frost sensor of the present invention is depicted in FIG. 4. The portions of the refrigerating equipment 20 shown in FIG. 4 that are identical to corresponding portions shown in FIGS. 1–2 are designated by the same reference numerals. In the frost sensor 60, a fiber optic cable 62 extends between a transmitter 64 and a receiver 66 and is positioned adjacent the evaporator coil 22. The cable 62 has a series of V-shaped notches or slits 68, 70, 72 and 74 formed along an edge 76 of the cable 62. When no ice or frost has accumulated on the evaporator coils 22 or along the cable 62, light emitted by the transmitter 64 is transmitted through the fiber optic cable 62 and is received by the receiver 66. The slits 68, 70, 72 and 74 affect the amount of light that is transmitted through the cable 62 and received by the receiver 66. As ice or frost builds up on the evaporator coils 22, ice and frost also accumulates in the notches 68, 70, 72 and 74 at a proportionate rate and the amount of light being received by the receiver 66 is altered. Once the amount of light being received at the receiver 66 has changed beyond a predetermined amount, circuitry coupled to or in the receiver 66 determines that an excess amount of ice and frost has accumulated on the evaporator coils 22 and a defrost cycle is initiated. Since the frost sensor 60 is able to determine when an excess amount of ice and frost has accumulated on the evaporator coils 22, a defrost cycle is initiated only when it is required. Moreover, the frost sensor 60 is also able to limit the duration of the defrost cycle because it can determine when the ice and frost have been sufficiently melted.

One example of the type of cable 62 that can be used in the frost sensor 60 is a cable that is one to two meters in length and has 4–14 notches, such as notches 68, 70, 72 and 74, per meter of length evenly spaced along the cable. The notches 68, 70, 72 and 74 can each be about 0.006" to 0.013" in depth with a width of about 0.008" to 0.03".

Different types of light transmitters and receivers can be used for the transmitters 32, 52 and 64 and for the receivers 34, 54 and 66. One suitable transmitter is available from Molex Incorporated, part No. 40398-E*-2S. One suitable receiver is also available from Molex Incorporated, part No. 40398-Al-2F. In addition, Molex Incorporated has available a fiber optic cable, part No. 41153-B Simplex, suitable for use as the cables 36, 56 and 62.

Figure 5:
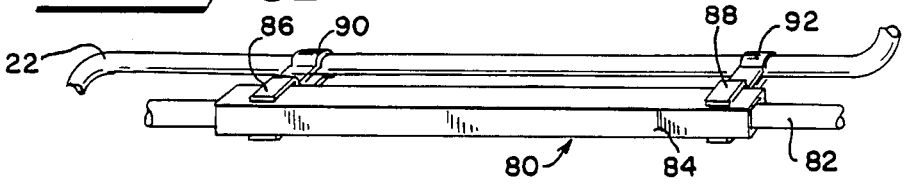
FIG. 5 is a perspective view illustrating a mounting bracket that can be used to mount a fiber optic cable adjacent to evaporator coils.

As can be appreciated, the cables 36, 56 and 62 must be maintained in close proximity to the evaporator coils 22 in order for the ice and frost to build up on the cables 36, 56 and 62 at a proportionate rate to the rate at which ice and frost builds up on the evaporator coils 22. In FIG. 5, a mounting bracket 80 is disclosed for mounting a fiber optic cable 82 adjacent the evaporator coil 22, the cable 82 being representative of any one of the cables 36, 56 and 62. The mounting bracket 80 includes a channel member 84 in which the cable 82 is disposed. Clips 86 and 88 extend from the channel member 84 and have resilient fingers 90 and 92, respectively, that are designed to snap onto the evaporator coils 22. In this manner, the cable 82 can be preassembled onto the mounting bracket 80 which in turn can be easily snapped onto the evaporator coils 22 so that the cable 82 is properly and easily positioned in close proximity to the evaporator coils 22.

It is noted that the manner, i.e., increase or decrease, and the magnitude of the change in the light transmitted through the fiber optic cable and received by the receiver may be determined experimentally for the various configurations and dimensions of the fiber optic sensor of the present invention. The change may then be compared to empirically derived data to calibrate the sensor so that a defrost cycle is initiated only when needed.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. A frost sensor for refrigeration equipment having a cooling means for cooling air, said frost sensor comprising:

a transmitter means for emitting light;

a receiver means for detecting light emitted by said transmitted means; and a fiber optic cable extending between said transmitter means and said receiver means, said fiber optic cable being continuous for transmitting light from said transmitter means through said fiber optic cable to said receiver means and said fiber optic cable being positioned adjacent to said cooling means so that the amount of light being transmitted by said fiber optic cable to said receiver means is altered by ice or frost accumulating on said fiber optic cable.

2. The frost sensor as set forth in claim 1 wherein said ice or frost accumulates on said fiber optic cable at a rate proportional to the rate at which ice or frost accumulates on said cooling means.

3. The frost sensor as set forth in claim 1 wherein said receiver means initiates a defrost cycle in response to a predetermined change in the amount of light received by said receiver means.

4. The frost sensor as set forth in claim 1 wherein said fiber optic means is a fiber optic cable coupled to said transmitter means and to said receiver means and is serpentined around said cooling means such that a plurality of bends are formed in said fiber optic cable.

5. The frost sensor as set forth in claim 4 wherein the amount of light being transmitted by said fiber optic cable to said receiver means is altered by an accumulation of ice or frost in said bends.

6. The frost sensor as set forth in claim 1 wherein said refrigeration equipment is included in an appliance and evaporator coils form said cooling means.

7. The frost sensor as set forth in claim 6 wherein said appliance is a refrigerator/freezer.

8. The frost sensor as set forth in claim 1 including a mounting bracket to mount said fiber optic cable in close proximity to said cooling means.

9. The frost sensor as set forth in claim 1 wherein said fiber optic cable is looped around said evaporator coils such that a plurality of bends are formed in said fiber optic cable, the amount of light being transmitted by said fiber optic cable being altered as ice or frost accumulates in said bends.

10. The frost sensor as set forth in claim 9 wherein each of said bends has a radius of curvature from 0.2 inch to 0.7 inch.

* * * * *